US006769935B2

(12) United States Patent
Stokoe et al.

(10) Patent No.: US 6,769,935 B2
(45) Date of Patent: Aug. 3, 2004

(54) MATRIX CONNECTOR

(75) Inventors: Philip T. Stokoe, Attleboro, MA (US); Thomas S. Cohen, New Boston, NH (US)

(73) Assignee: Teradyne, Inc., Boston, MA (US)

( * ) Notice: Subject to any disclaimer, the term of this patent is extended or adjusted under 35 U.S.C. 154(b) by 0 days.

(21) Appl. No.: 10/062,392

(22) Filed: Feb. 1, 2002

(65) Prior Publication Data

US 2002/0102881 A1 Aug. 1, 2002

Related U.S. Application Data

(60) Provisional application No. 60/265,826, filed on Feb. 1, 2001.

(51) Int. Cl.[7] ..... H01R 13/648
(52) U.S. Cl. ..... 439/608
(58) Field of Search ..... 439/608, 701, 439/717, 594, 607, 101, 108, 61, 65

(56) References Cited

U.S. PATENT DOCUMENTS 5,316,501 A 5/1994 Mair ..... 439/607
5,433,618 A * 7/1995 Morlion et al. ..... 439/108
5,795,191 A * 8/1998 Preputnick et al. ..... 439/608
5,904,594 A * 5/1999 Longueville et al. ..... 439/608
5,934,939 A 8/1999 Thenaisie et al. ..... 439/607
5,980,321 A * 11/1999 Cohen et al. ..... 439/608
5,993,259 A 11/1999 Stokoe et al. ..... 439/608
6,083,047 A * 7/2000 Paagman ..... 439/608
6,146,202 A * 11/2000 Ramey et al. ..... 439/608
6,293,827 B1 * 9/2001 Stokoe ..... 439/608
6,409,543 B1 * 6/2002 Astbury et al. ..... 439/608
6,520,803 B1 * 2/2003 Dunn ..... 439/608
6,540,522 B2 4/2003 Sipe ..... 439/61

* cited by examiner

*Primary Examiner*—Renee Luebke
*Assistant Examiner*—Felix O. Figueroa
(74) *Attorney, Agent, or Firm*—Edmund J. Walsh; Teradyne Legal Department

(57) ABSTRACT

An electrical connector assembly suitable for use in a matrix assembly. The electrical connector assembly has two connectors, each assembled from wafers. The individual wafers are sheilded and separate shield pieces are positioned in one connector transverse to the wafers in that connector. Additionally, wafers in at least one of the connectors includes a compliant portion that allows the two connectors to be self-aligning.

24 Claims, 10 Drawing Sheets

MATRIX CONNECTOR

RELATED APPLICATIONS

This application claims priority to U.S. provisional application 60/265,826 filed Feb. 1, 2001, which is hereby incorporated by reference.

BACKGROUND

Electronic systems are often assembled from several printed circuit boards. These circuit cards are sometimes referred to as "daughter boards." The daughter boards are held in a card cage. Electrical connections are then made between the daughter boards.

One traditional approach is to interconnect the daughter cards using a backplane. The backplane is a large printed circuit board with few, if any, active components attached to it. Mainly, the backplane contains signal traces that route electrical signals from one daughter card to another. It is mounted at the back of the card cage assembly and the daughter cards are inserted from the front of the card cage. The daughter cards are in parallel to each other and at right angles to the backplane.

For ease of assembly, the daughter cards are connected to the backplane through a separable connector. Often, two-piece electrical connectors are used to join the daughter cards to the backplane. One piece of the connector is mounted to each of the backplane and a daughter card. These pieces mate and establish many conducting paths. Sometimes, guide pins are attached to the backplane that guide the daughter board connector into proper alignment with the backplane connector.

A two piece electrical connector has contacts in each piece of the connector that are adapted to make electrical contact when the two pieces mate. A traditional backplane connector has contacts that are shaped as pins or blades and the daughter card contact has contacts that are shaped as receptacles. Each pin is inserted into a receptacle when the connectors mate.

To make a high speed, high density connector, shielding is often added to the connectors. U.S. Pat. No. 5,993,259 to Stokoe, et al. represents a desirable shielding design and is hereby incorporated by reference. Teradyne. Inc., the assignee of that patent markets products called VHDM™ connectors that are commercially successful.

Not all electronic assemblies employ a backplane. Some use a midplane configuration. In a midplane configuration, daughter cards are inserted into both the front and the back of the card rack. Another printed circuit board, called the midplane, is mounted in the center of the card cage assembly. The midplane is very similar to a backplane, but it has connectors on both sides to connect to the daughter boards inserted from the front and the back of the assembly.

A further variation is called a matrix configuration. In the matrix configuration, daughter boards (such as shown as 112, 112(2) and 116, 116(2) and 116(3) in FIG. 1) are inserted from both the front and the back of the card cage. However, the boards inserted from the front ore perpendicular to the boards inserted from the back. Connectors are mounted at the interconnection of these circuit boards to make connections between the boards.

Currently, there exists no suitable high speed, high density connectors for some matrix configurations.

SUMMARY OF THE INVENTION

With the foregoing background in mind, it is an object of the invention to provide a high speed high density connector for a matrix configuration.

It is also an object to provide a matrix connector that is easy to manufacture.

The foregoing and other objects are achieved in a connector with two intermateable pieces. Each piece is made from a plurality of wafers that include a plurality of signal conductors and at least one ground conductor. The wafers are oriented so that they will be perpendicular when installed in a matrix configuration. One of the connector pieces includes a plurality of orthogonal shield pieces that are orthogonal to the ground conductors in that piece and parallel to the ground conductors in the mating piece. The orthogonal shield pieces are electrically connected to ground conductors in each of the connector pieces.

BRIEF DESCRIPTION OF THE DRAWINGS

The invention will be better understood by reference to the following more detailed description and accompanying drawings in which.

DESCRIPTION OF THE PREFERRED EMBODIMENT

Figure 1:
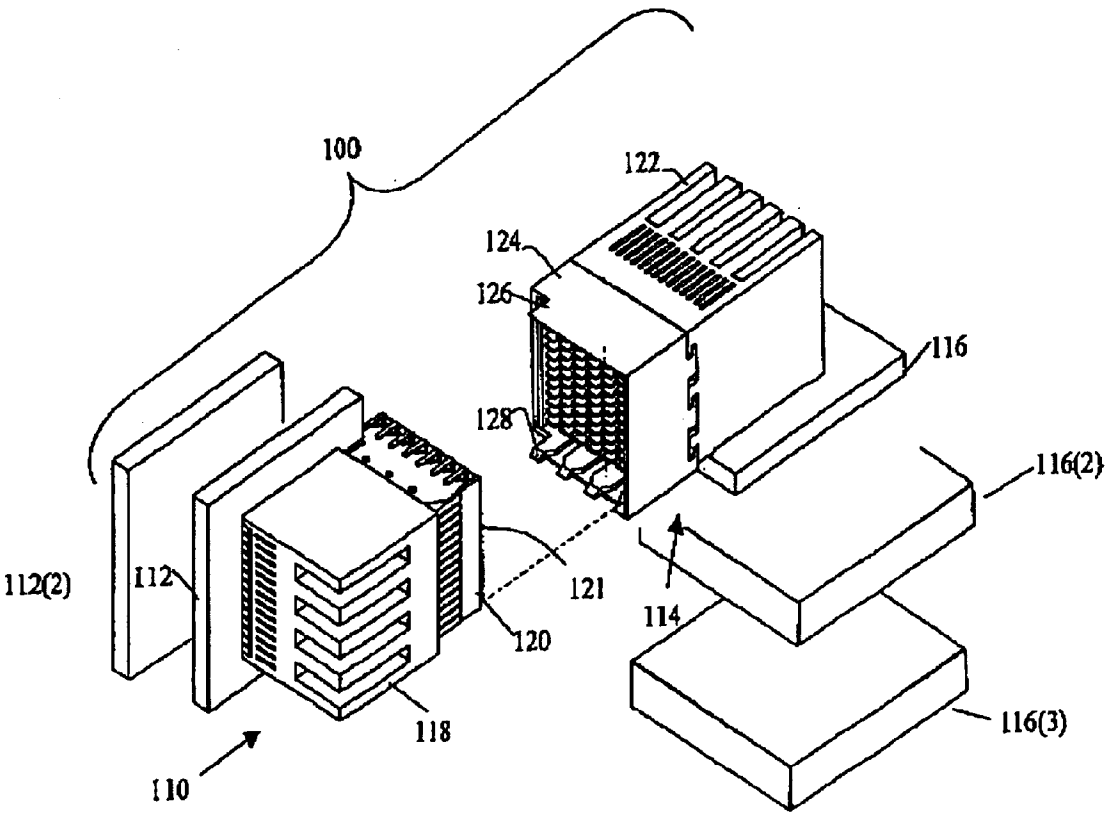
FIG. 1 is a illustration of a matrix assembly according to the invention.

FIG. 1 shows a portion of a matrix assembly 100. Assembly 100 includes a vertical board 112 and a horizontal board 116. A type A connector is mounted to board 112 and a type B connector is mounted to board 116. The connectors 110 and 114 each have numerous signal and ground contact tail 230 that make electrical connection to circuit traces on or within the boards. Additionally, each of the connectors have conducting elements that with mating portions 232 (FIG. 2) and 832 (FIG. 8). The mating portions are positioned so that when the type A connector and the type B connector are mated, numerous circuit paths will be completed between board 112 and board 116.

In the illustrated example, boards 112 and 116 are conventional printed circuit boards as traditionally found in a matrix assembly. It will be appreciated that only very small boards are shown. In a commercial implementation, each board would be larger and contain numerous electrottic devices.

Also, it should be appreciated that a commercial embodiment of a matrix assembly is likely to have more than just two boards. For example, a matrix assembly is more useful when multiple horizontal boards are connected to the same vertical board. In this way, the vertical board can route electrical signals between the vertical boards. A matrix assembly is likely to be even more useful if multiple vertical boards are included along with multiple horizontal boards.

In this way, a system designer has significant flexibility in routing signals between printed circuit boards.

In the embodiment illustrated in FIG. 1, type A connector 110 includes a housing 118 and a cap 120. As will be described in greater detail below, each of the connector is made up of a plurality of subassemblies or wafers (310 FIG. 3) that contains signal conductors.

Housing 118 holds the rear portions of the wafers. In the illustrated embodiment, housing 118 is an insulative housing, preferably made of plastic or other material typically used in the manufacture of electrical connectors.

Cap 120 is also made of insulative material in the illustrated embodiment. Cap 120 provides the mating face of type A connector 110. It positions the contact portions of the conductive members inside the connector and also protects them from physical damage.

Cap 120 further aids in providing "float" or "compliance." Cap 120 includes features, such as tapered surface 121 that generates force in a direction that tends to align caps 120 and 124 as the two connectors are mated. The compliance mechanism of the connector is described in greater detail below.

Likewise, type B connector 114 includes a housing 122 and a cap 124. As with the type A connector, housing 122 holds wafers (210 FIG. 2) in position. Cap 124 also positions and protects the contact portions of the conductive members inside the connector. Cap 124 provides includes a shroud, such as formed by projecting walls 126, to protect the contacts.

The shroud also serves to provide alignment between the type A and type B connectors as they mate. In the illustrated embodiment, cap 120 fits within the shroud. When cap 120 is engaged in the shroud, the contact elements from the A type connector align with the contact element in the B type connector.

To further the alignment, walls 126 include alignment features 128. Alignment features 128 engage with complementary alignment features on cap 120 to aid in guiding the connectors into a mating position. Preferably, the alignment features have tapered surfaces, such as 130 (FIG. 2), to guide the front face of the connectors into the appropriate position in the Y direction. Tapered surfaces 132 (FIG. 2) engage 15 complementary features on the mating connector to guide the connectors into appropriate alignment in the X direction. In the illustrated embodiment, cap 124 is compliant and pressing a mating connector into cap 124 aligns cap 124 with the mating connector.

Figure 2:
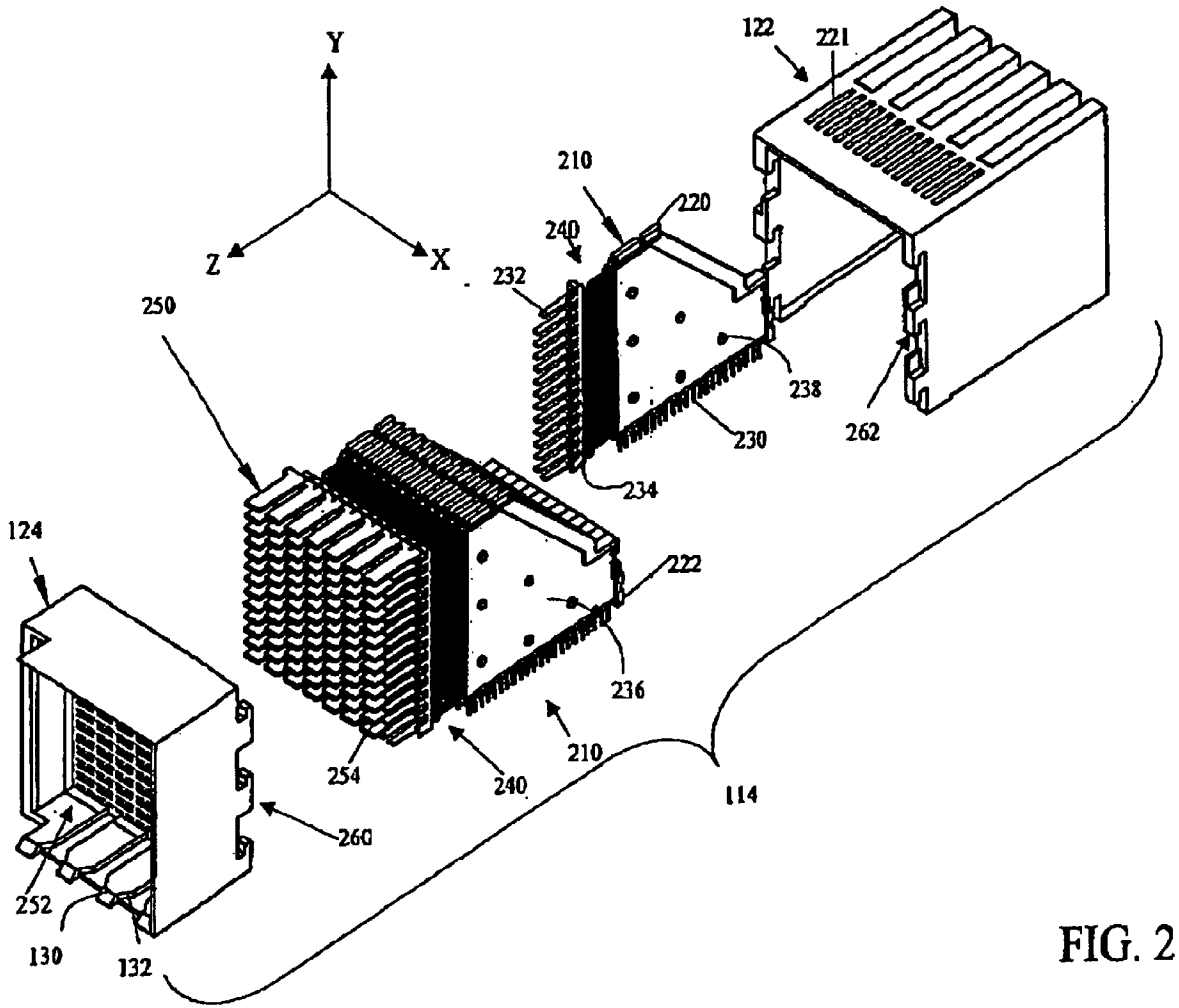
FIG. 2 is an exploded view of a first type connector of FIG. 1.

Turning now to FIG. 2, type B connector 114 is shown in exploded view. A plurality of wafers 210 are shown stacked side by side. The wafers fit within housing 122. In the illustrated embodiment, each wafer contains features, such as 220 and 222 that engage other features within housing 122 to hold the wafers in place.

Various engagement features might be used. In the illustrated embodiment, feature 220 includes a tab that engages a slot 221 on the housing 122. If desired, feature 220 might also include a latch to prevent the wafer from sliding out once engaged. Feature 222 includes a tab or boss or similar protrusion to engage a complementary opening on the inside of housing 122.

Each wafer includes conducting elements. In the preferred embodiment, some of the conducting elements are designed to carry signals. Others of the conducting elements are intended to be connected to ground. The ground conductors also can serve as shields to reduce distortion carried on the signal conductors.

The conducting elements are connected to the printed circuit board 116. Contact tails 230 project from a lower edge of the wafer. In the illustrated embodiment, the contact tails are press fit contacts that engage holes in the surface of a printed circuit board.

The conducting elements also include portions that extend from the forward edge of wafer 210. In the preferred embodiment, the signal conductors extend from the forward edge of the wafer as mating contact portions 232. In FIG. 2, the mating contact portions are illustrated as blades. However, it should be appreciated that multiple forms of mating contacts are known—such as pins, receptacles or beams—and could be used.

The ground conductors in the preferred embodiment take the shape of shield plates 236 that lies flat against the major surface of the wafer. Hubs 238 extend from wafer 210 and pass through holes in plate 236, thereby holding it securely to the wafer.

Ground plate 236 includes contact tails 230 that press fit into ground holes in printed circuit board 116. Ground plate 236 also includes a connection portion that extends from the forward edge of the wafer. The forward edge of ground plate 236 includes contacts 240 that are adapted to mate to shields 250.

As shown in FIG. 2, each of the wafers 210 contains a column of signal contacts. Shield plate 236 shields a column from the column provided by an adjacent wafer in the body of the wafer.

When the wafers are assembled side by side, the columns of signal contacts make a rectangular array of signal conductors. In the illustrated embodiment, the array will be a square array. Each wafer contains a column of fourteen signal contacts and fourteen wafers are aligned side by side to make fourteen rows of fourteen contacts each.

Shields 250 are positioned between the rows of signal contacts in the region of the mating contact portions. Shield plates 250 are electrically connected to the shield plates 236. Each shield plate 250 engages a contact 234 on each of the shields 236. Much of the length of each signal conductor is adjacent to either one of the shield plates 236 or one of the shields 250. In this way, shielding is provided substantially over the length of the signal conductors.

In between the body of the wafer and the contact portions are compliant portions 240, which is described in greater detail below. These complaint portions allow the portions of the wafer containing the mating contacts to move relative to the rear portion of the wafers. Also, it should be noted that the attachment points of the wafers, such as 220 and 222 are on the rear portions. Thus, while the rear portion of the wafers are fixed to the housing and to the printed circuit board, the mating contact portions can move relative to the board and the housing. In the preferred embodiment, the compliant portions adjusts for mis-alignment between the mating pieces of the connectors.

The shield plates 250 fit into the cap 124 and are secured with any convenient means. For example, each edge of the shield plates 250 might fit into a slot in a wall of cap 124. However, in the illustrated embodiment, cap 124 has a floor 252 that includes numerous openings. Each shield plate 250 is cat with slit creating fingers 254 Each of the fingers project through an opening in floor 252 creating a muting surface within the shroud created by the walls 126 of cap 124. In the illustrated embodiment, the shield plates are held firmly to the cap through an interference fit.

Mating portions 232 project through openings in floor 252. Preferably, the openings are so small that they create an interference fit with the mating portions 232 to secure them to cap 124. Likewise, they are situated to provide a mating area within shroud created by the walls 126 of cap 124.

In the preferred embodiment, cap 124 is not rigidly attached to housing 122. A means of attachment is used to provide compliance to cap portion 124. Because there is compliance in cap portion 124, there is also compliance in the mating area within cap 124. Significantly, if the connectors 110 and 114 are misaligned, the compliance allows the mating contacts of each connector to properly align nonetheless.

In the illustrated embodiment, the compliance is provided with attachment features 260 on cap 124 and attachment features 262 on housing 122 that allow a sliding form of attachment in combination with compliance sections 240 on all of the conductors. Preferably, the specific form of attachment allows the cap to move in the plane illustrated as the X-Y plane in FIG. 2. It is also preferable that the attachment not allow compliance in the direction illustrated as Z. As the connector pieces 110 and 114 are pushed together for mating, it is desirable that the mating portions come into alignment in the X-Y plane. A rigid attachment in the Z direction is desirable so that sufficient mating force can be generated.

As described above, the electrical conductors have portions that are rigidly attached to the printed circuit board 116. They also have portions that are attached to cap 124. But, these two portions are separated by compliant portions 240. In this way, electrical connections can be made through the connector while still providing the compliance necessary to ensure proper mating.

Figure 3:
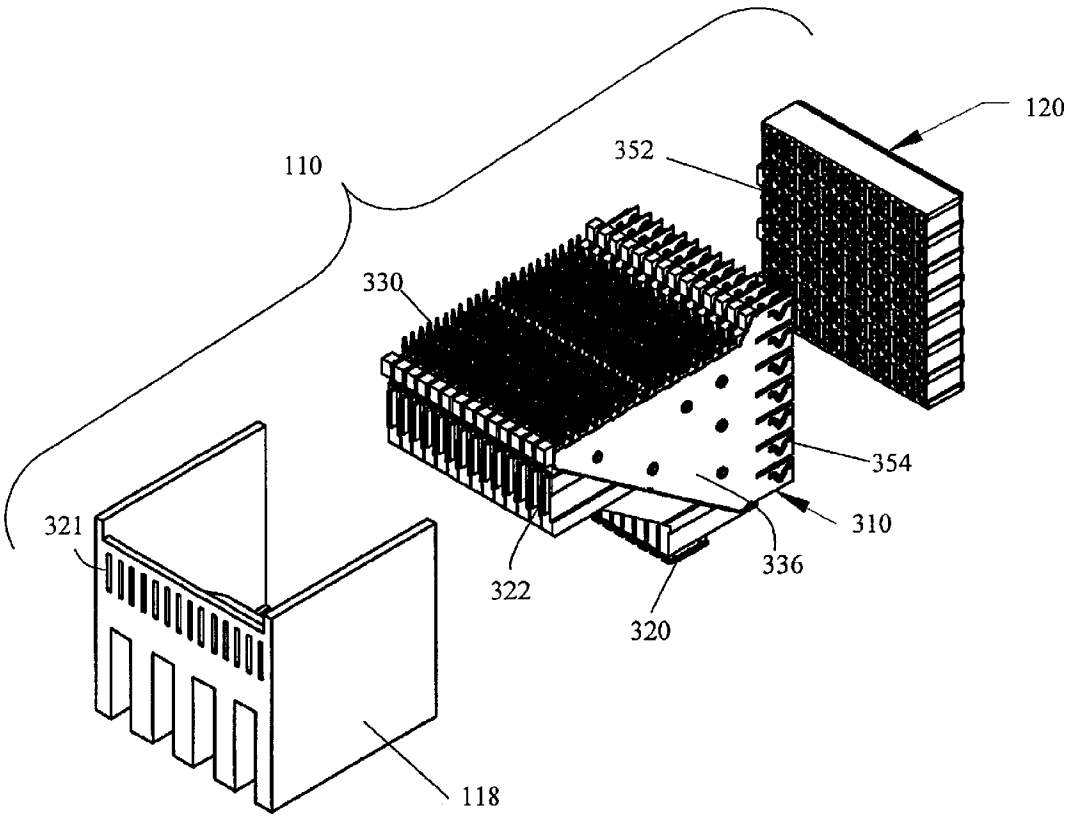
FIG. 3 is an exploded view of a second type connector of FIG. 1.

Turning now to FIG.3, a type A connector 110 is shown in exploded view. The connector contains a plurality of wafers 310. As with wafers 210, wafers 310 include a plurality of signal conductors and a shield 336. A plurality of contact tails extend from a lower surface of the wafers for attachment to printed circuit board 112.

Wafers 310 are stacked side-by-side, with their major surfaces In parallel. The wafers are secured to housing 118. Attachment features 322 on the wafers 310 engage slots 321 in the housing 118. Likewise, features 320 engage other slots in housing 118.

In the illustrated embodiment, each wafer includes fourteen electrically separate conductors that are intended to act as signal conductors. Fourteen wafers are stacked side by side to make a rectangular array with the same number of rows and columns. And, as with the type B connector 114, the pitch between the contacts in a wafer is the same as the spacing between adjacent wafers. Thus, despite the fact that the wafers in the type A connector 110 and the wafers in the type B connector 114 are orthogonal, each connector has a mating interface with contacts in a rectangular array with contact spacings that allows the conductors to mate.

The conductors of wafers 310 have mating portions that extend at the forward edge of the wafer, In the preferred embodiment, theme mating portions fit within recesses formed in the lower surface 352 of cap 120. An in a traditional connector, the recesses within cap 120 are accessible through openings in the mating face of cap 120. As connector 110 is mated with connector 114, cap 120 fits within the walls of cap 124, bringing the mating contact portions of the conductors from connector 110 into the mating area. The mating portions of the signal conductors from connector 114 pans through the openings in the mating face of cap 120 and make electrical contact with the mating contact portions of the conductors from connector 110.

In the illustrated embodiment, the mating contact portions of the signal conductors of connector 114 are blades. The mating contact portions of the signal conductors from connector 110 must be of the type that makes a suitable electrical connection to a blade. Preferably, the mating contact portions of the signal conductors in connector 110 will include one or more beams bent in such a way to generate spring force against that blade. Preferably, two separate beams positioned in parallel to create a split beam type contact create the mating contact portion of the signal conductors in connector 110.

The mating contact portions for the ground conductors in connector 114 are the fingers 254. Fingers 254 also provide a blade-like mating contact portion. As can be seen in FIG. 3, shields 336 also have fingers 354 in their mating areas. However, rather than being completely flat, fingers 354 have beams 830 (FIG. 8) cut in them. In the illustrated embodiment, the beams are secured to the shield plate at two ends, but bent out the plane of the shield in the middle. This arrangement allows the beams to generate a spring force.

During mating, fingers 254 from one of the shields 250 will be parallel to and adjacent fingers 354 from one of the shields 336. The spring force generated by the beams 830 will create the necessary electrical connection between the shields. In this way, the shields in connector 110 are electrically connected to the shields in connector 114.

Turning now to FIG. 4, a manufacturing process for wafer 210 is illustrated. FIG. 4A shows a lead frame 410. The lead frame 410 is stamped from a sheet of conductive material of the type traditionally used to make signal contacts in an electrical connector. Preferably, a copper alloy is used.

When lead frame 410 is stamped, carrier strips 412 are left to allow easier handling of the lead frame. The lead frame is held to the carrier strip 412 by a plurality of tie bars 414. And, the signal conductors 416 are joined by tie bars 415. The tie bars 415 are eventually cut to leave a plurality of electrically separate signal contacts 416. And the tie bars 414 are eventually cut to separate the wafer 210 from the carrier strips.

As can be seen, each signal contact has a contact tail 230, a mating contact portion 232, a compliant portion 240 and an intermediate portion, between the complaint portion and the contact tail.

In a preferred embodiment, multiple lead frames are stamped from a long strip of conductive material. The lead frames are joined by the carrier strips 412 and wound on a reel (not shown). In this way, an entire reel of wafers 210 can be processed and easily handled. However, for simplicity, only a portion of the reel is shown.

Once the lead frame 410 is stamped to the required shape, a forming operation might be used. The forming operation creates any features on the lead frame 410 that are out of the plane of the sheet of material used to make the lead frame. The precise shape and amount of forming will depend on the design of the signal contact. In the illustrated embodiment, the mating contact portions 232 are bent at a 90° angle relative to the plane of the lead frame 410. This bend places the smooth, flat surface of the contact portion perpendicular to the plane of lead frame 410. In use, the mating contact portion from the connector 110 will press against the flat surface of the contact portion 232 when bent at this angle. It is preferable to have the contacts mate on a smooth surface.

Figure 4B:
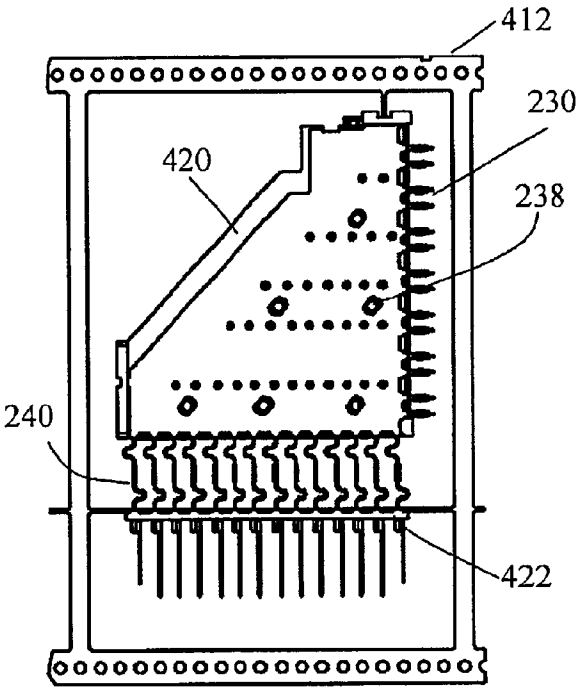
FIGS. 4A–4D is a series of figures showing steps in the manufacturing process of a wafer of FIG. 2.

FIG. 4B illustrates another step in the manufacture of the wafer 210. The lead frame is placed in a mold and an insulator 420 is molded around the intermediate portions of the signal conductors. Insulator 420 locks the signal conductors 416 in place. It also provides mechanical support to the wafer 210 and insulates the signal conductors to avoid electrical shorts. Insulator 420 might be any suitable plastic, such as those which are traditionally used in the manufacture of electrical connectors.

Insulator 420 is shown with a plurality of hubs 238 molded therein for later attachment of a shield. The surface of insulator 420 is molded to receive the shield 236.

FIG. 4B also shows a forward insulator 422 molded across the signal conductors at the proximal end of the signal contacts 232. Forward insulator holds the signal contacts together when the tie bars are severed. It also provides a point of attachment for a manufacturing tool that can be used to press the signal contact portion of the wafers into cap 124.

Figure 4A:
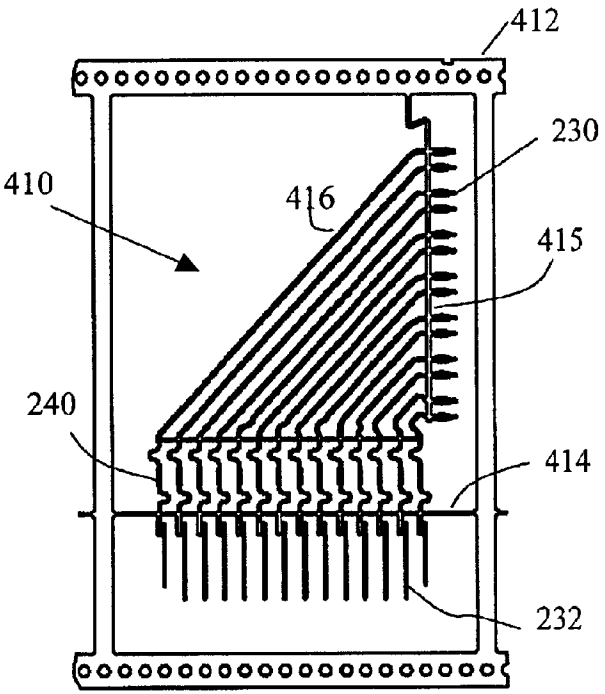
Figure 4D:
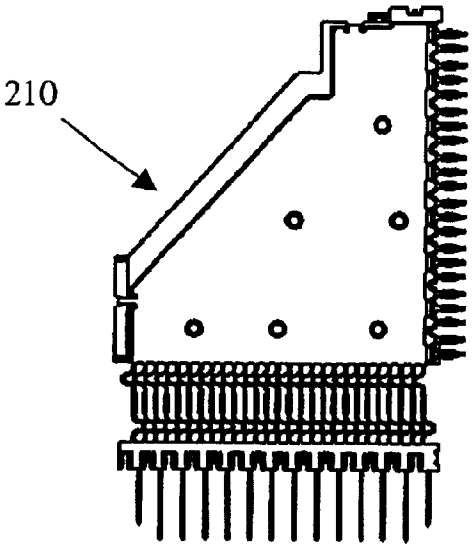
Figure 4C:
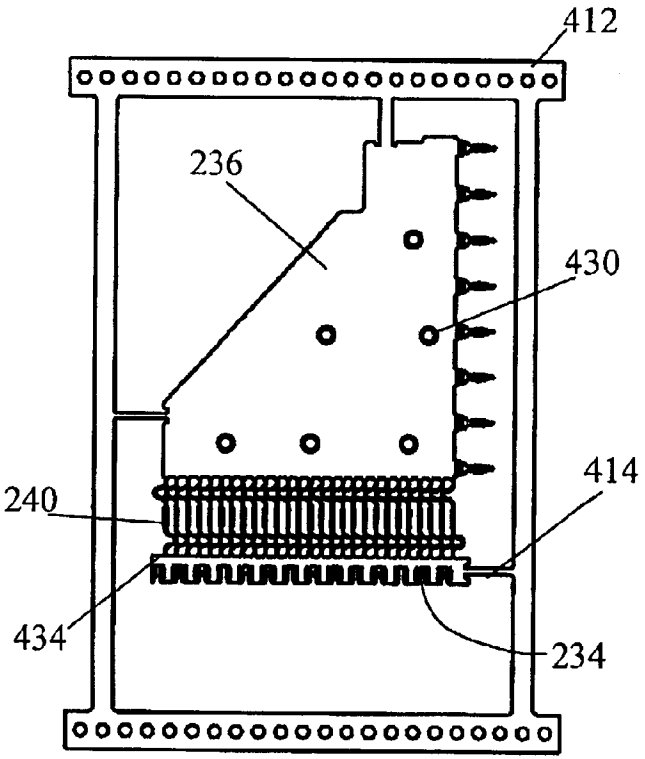

FIG. 4C shows a shield 236 before attachment to wafer 210. As with the signal contacts, a plurality of shields are stamped from a sheet of conductive material and held together on carrier strips. Shield 236 is stamped with a plurality of holes 430 to engage the hubs 238. The positioning of holes 430 and hubs 238 holds a generally planar intermediate portion adjacent the insulator 420.

Shield 236 is also stamped with a plurality of compliant portions 240, extending from the intermediate portion. In the illustrated embodiment, there are approximately the same number of compliant portions 240 on each shield 236 as there are signal conductors in the wafer. This number of compliant portions provides for an appropriate flow of ground current and also the appropriate amount of compliance. More complaint portions 240 additionally provide greater shielding.

A forward portion 434 extends from the complaint portions 240. Forward portion 434 is secured to cap 124. Shield contacts 234 are formed on forward portion 434.

As with the signal contacts, the shield 236 might be formed after stamping to provide features that extend out of the plane of the conductive sheet used to make the shield. Contact portions 230 also extend from the intermediate portion of shield 236 and can be formed.

FIG. 4D shows wafer 210 at a later stage of assembly. A shield plate 236 is overlaid on the insulator 420. The shield plate is pressed to engage the hubs 238 in holes 430. The tie bars 414 are cut to release wafer 210 from the carrier strips 412. Wafer 210 is then ready for insertion into housing 122.

Other manufacturing operations as known in the art might be included in addition to the ones shown herein. For example, it might be desirable to coin the edges of the signal contact portions 232. Alternatively, it might be advantageous to gold plate some of the contact portions.

Figure 5:
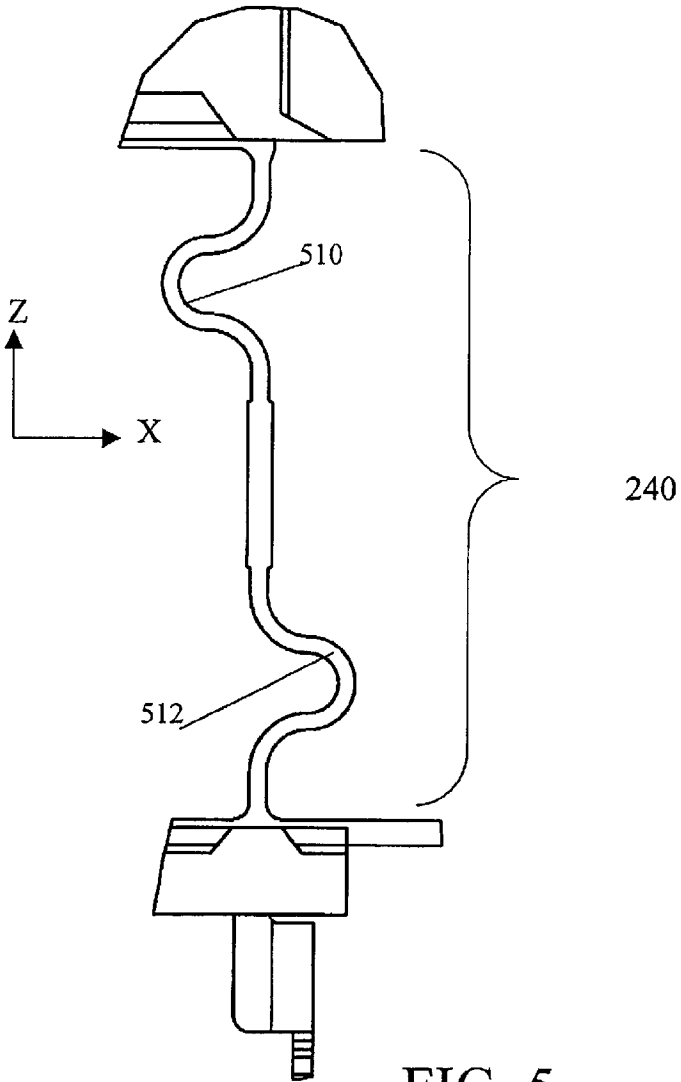
FIG. 5 is an illustration of a preferred embodiment of a compliant section.

FIG. 5 shows additional details of a compliant portion 240. As can be seen, the compliant portion is generally elongated. However, in the illustrated embodiment, the compliant portion includes bends to increase the amount of compliance. In the illustrated embodiment, bends 510 and 512 are included. Preferably, bend 510 and 512 bend in opposite directions to provide compliance in the X and Y directions, without permanent deformation of the contact, thereby providing a self-centering feature to the connector. The number, size and shape of the bends could be varied. However, it is preferable that the complaint portion include smooth bends to provide more desirable electrical properties. In addition, the curved portions additionally provide compliance in the Z direction. While it is generally preferred that the caps engage to preclude motion in the Z direction, there will be some manufacturing tolerances that allow some motion in that direction.

In the preferred embodiment, the complaint portions are approximately 8 mm long made with material with a cross section that is approximately 8 mils square. The amount of compliance can be increased by increasing the length of the compliant section or increasing the radius or number of curved portions. Conversely, if less compliance is needed, the curves could be removed, the segments shortened or a thicker material might be used.

Figure 6B:
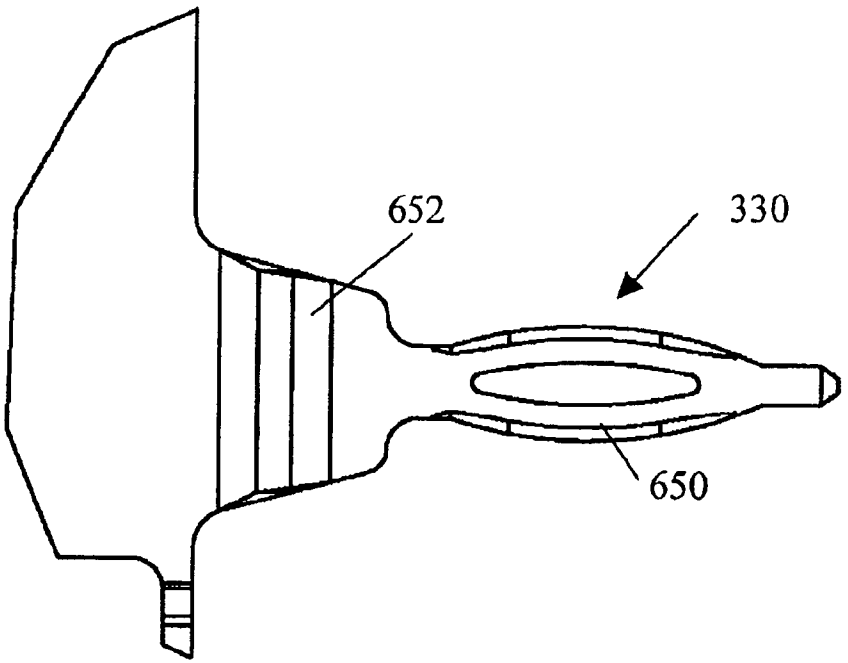
FIGS. 6A and 6B are illustrations showing additional details of features on the shield of FIG. 4C.
Figure 6A:
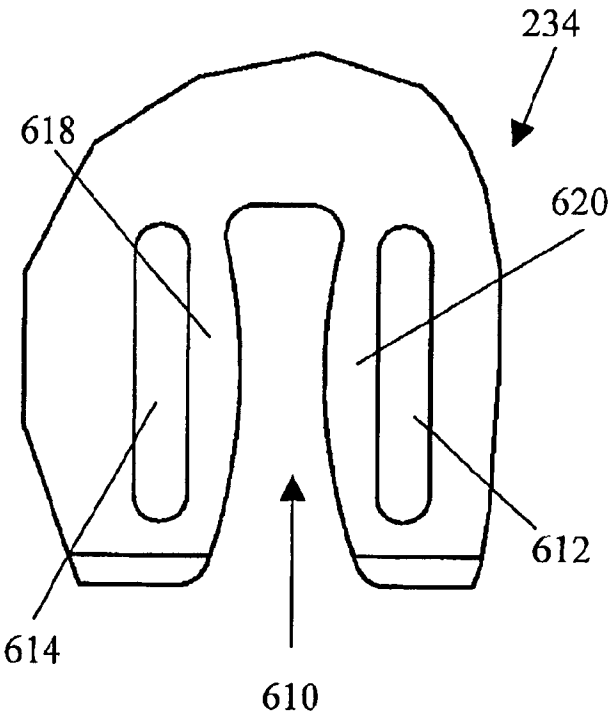

Turning to FIG. 6, additional details of features of shield 236 are shown. FIG. 6A shows a contact 234. The contact is stamped into forward portion 434 (see FIG. 4C ). A gap 610 is provided. Slots 612 and 614 ire also stamped in the shield, leaving beams 618 and 620.

Gap 610 is narrower than the thickness of a shield 250. Thus, as shield 250 is pressed into the slot 610, beams 618 and 620 will be deformed back into slots 612 and 614. However, beams 618 and 620 will generate a substantial amount of force against shield 250. Preferably, the amount of force is sufficient to create a gas tight seal between shield 250 and shield 236.

Turning to FIG. 6B, details of contact tail 230 on shield 236 are shown. In the preferred embodiment, contact tail 230 includes a press-fit portion 650. Tab 652 joins press fit portion 650 to the intermediate portion of shield 236. Here, tab 652 has been bent out of the plane of the intermediate portion of shield 236. The bend aligns the press fit portion 650 with the press fit sections of the signal conductors.

FIG. 4A shows that the contact tails of the signal conductors are grouped in pairs with a gap in between each pair. When shield 236 is installed on a wafer 210, each of the contact tails for the shield 236 will fit between an adjacent pair of signal conductors.

Figure 7A:
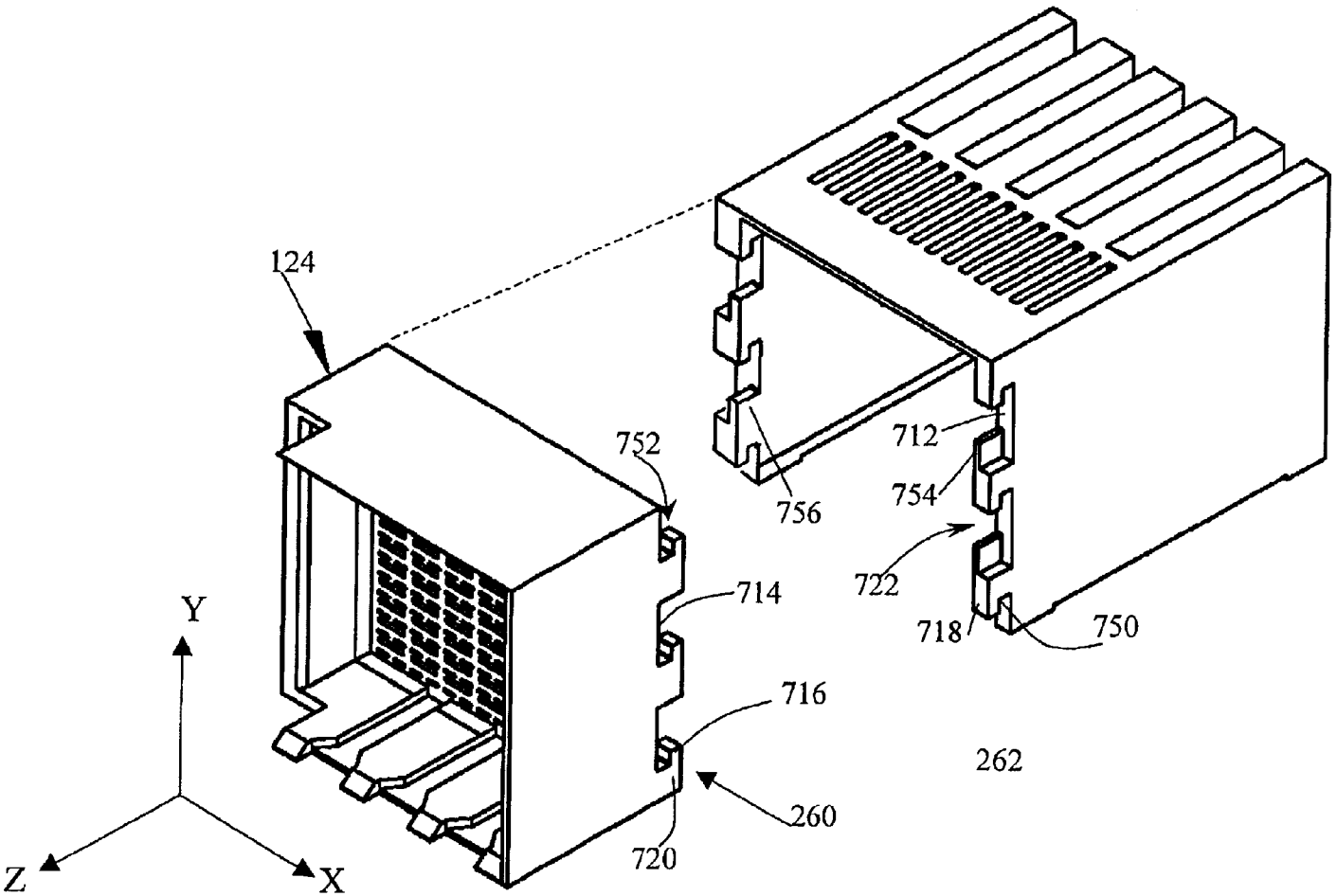
FIGS. 7A and 7B are sketches showing additional detail of the compliant attachment of the preferred embodiment.
Figure 7B:
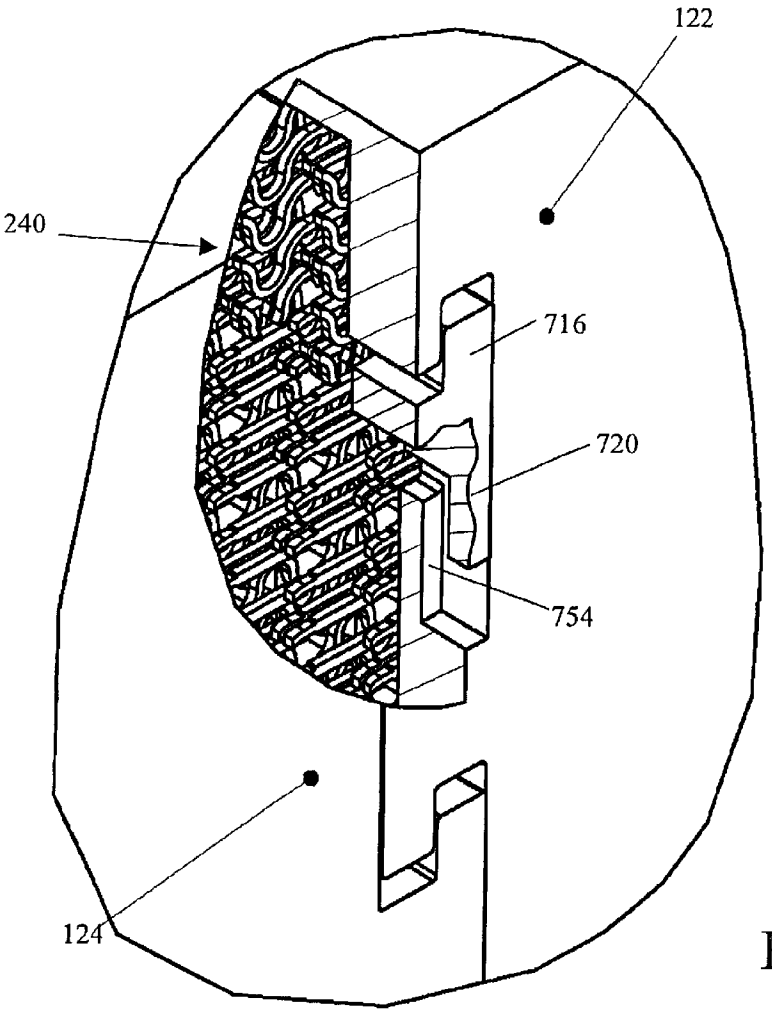

Turning now to FIG. 7, additional details of the compliant attachment between cap 124 and housing 122 are shown. In the illustrated embodiment, the attachment features are on two opposing sides of the housing 122. There are three sets of attachment features 260 and 262 aligned to engage.

Feature 260 includes a tab 716 held away from the surface 714 of cap 124 by a projection 720. This arrangement creates a slot 752 between surface 714 and lip 716.

Feature 262 includes an opening 722 with a rear wall 712. A lip 718 extends into the opening 722 a distance spaced from rear wall 712. This arrangement creates a slot 754 between rear wall 712 and lip 718.

In a preferred embodiment, slot 752 is the same thickness as the width of lip 718 and slot 750 is the same width as the thickness of tab 716. Thus, when attachment features 260 and 262 are engaged, tab 716 is held in slot 750 and lip 718 is held in slot 752. Neither has sufficient play to move a significant amount in the Z direction.

However, the fit should not be so tight as to create an interference fit that precludes all movement. Tab 716 should be able to slide in the X-Y direction within slot 750 and lip 718 should be able to slide in the X-Y direction in slot 752.

Attachment features 262 includes stops that prevent cap 124 from sliding so far as to become disengaged from housing 122. Stop 754 prevents excessive motion to the left in FIG. 7A. Stop 756 prevents excessive motion to the right in FIG. 7A. Up motion is restrained by lip 718 pressing against projection 720. Down motion is restrained when an alignment feature 260 presses against the alignment feature 262 below it.

However, as shown more clearly in the partially cut away view of the engaged alignment features, there is sufficient play between the features 260 and 262 to allow motion in the X-Y plane. For example, projection 720 is made narrow enough to provide 0.5 mm of movement before either stop 754 or 756 is engaged. And, slot 722 is long enough to allow 0.5 mm of movement before lip 718 engages tab 716 or attachment feature 260 bottoms on the attachment feature 262 below it. To provide this amount of compliance, the complaint portions are made approximately 8 mm long of material that is approximately 8 mils square.

Turning to FIG. 8, details of a wafer 310 are shown. As with wafer 210, wafer 310 is preferably made by first embedding a lead frame containing signal contacts in an insulator 820 to make a signal contact subassembly. The lead frame is stamped from a sheet of conductive metal and then formed into the desired shape. In the illustrated embodiment, mating contact portions 832 are formed into split beam type contacts by first stamping two beams and then bending the beams to a shape which generates adequate spring force for mating. Once the lead frame is encapsulated in insulator 820, the individual signal contacts are severed.

Figure 8B:
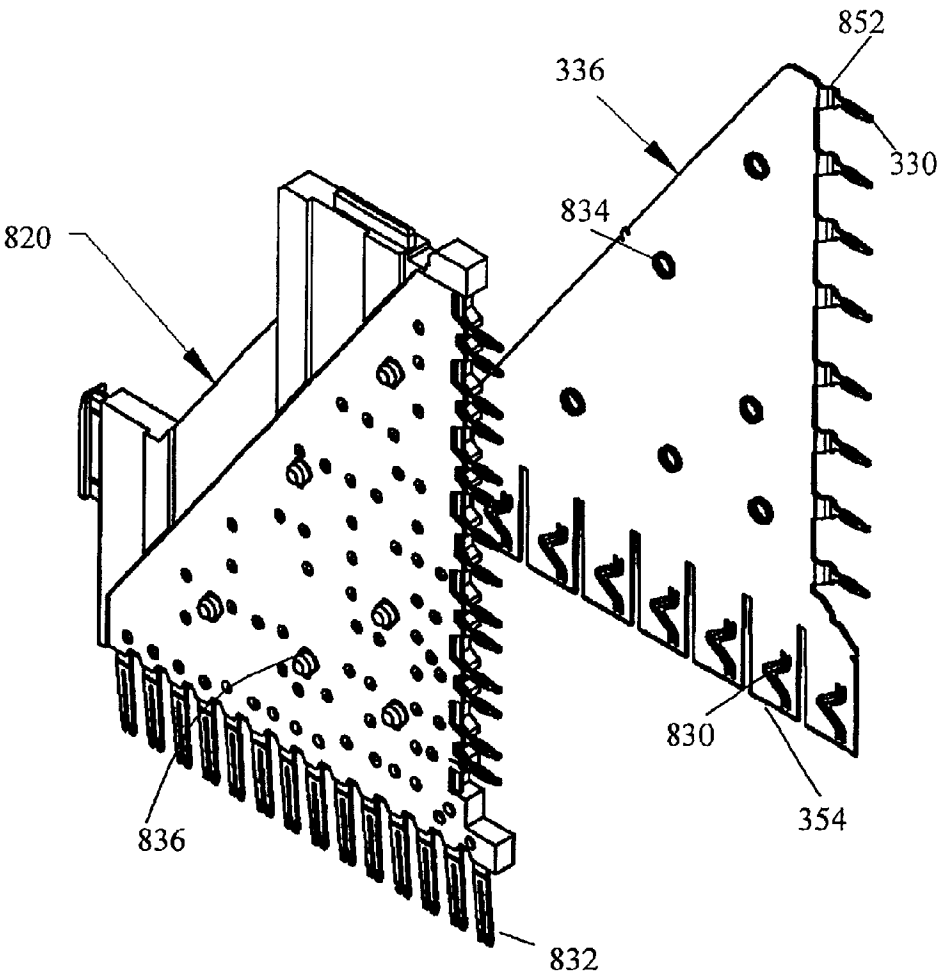
FIGS. 8A and 8B are sketches showing additional details of the wafer of FIG. 3.
Figure 8A:
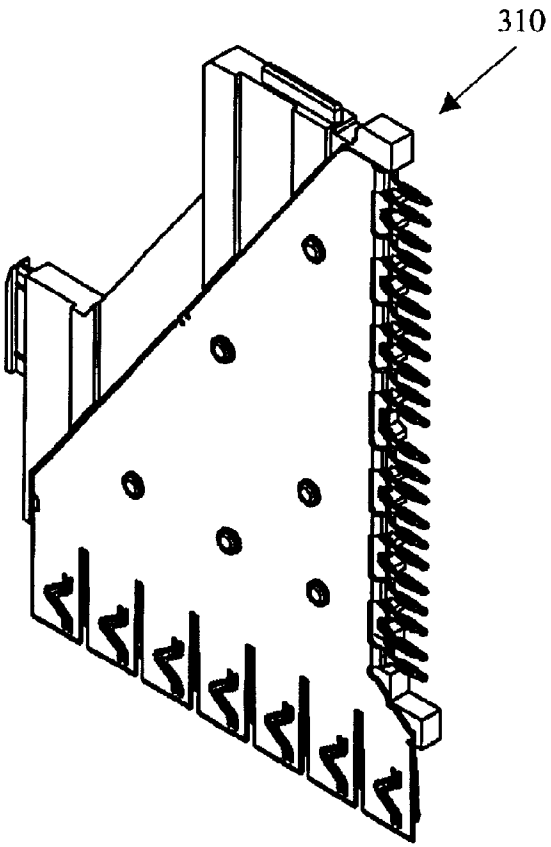

Separately, a shield 336 is stamped and formed. In the preferred embodiment, it is attached to insulator 820 to create a shielded subassembly. Holes 834 engage hubs 836 to hold shield 336 in place. FIG. 8A shows the wafer with the shield attached. FIG. 8B shows the signal contact subassembly and the shield separately.

Shield 336 also has features stamped and formed In it for making electrical connection. A contact tail 330 is attached to a tab 852. Tab 852 is bent such that when shield 336 is attached to insulator 820 the contact tails 33O of the shield 336 are aligned with the contact tails from the signal contacts. As described above, the contact tails are intended to make electrical connection to signal traces within a printed circuit board.

Shield 336 also makes an electrical connection to a shield 250 in a mating connector. A beam 830 is stamped in each finger 354. The beam is bent out of the plane of shield 336 so that, as fingers 354 slide against the shield 250, beams 830 are pressed back into the plane of the shield, thereby generating the required spring force to make an electrical connection between the shields in the mating connectors.

In this way, a connector that is easy to manufacture is provided for a matrix application. Waferized construction is used for both halves of the connector. And, the connector is self-aligning, allowing it to correct for greater positional inaccuracies in the manufacture of the matrix assembly, making it easier to manufacture an electronic system using a matrix configuration of printed circuit boards. A self-aligning connector is particularly important for a matrix assembly because without a single structure, like a backplane or a midplane, to provide references, there is greater opportunity for manufacturing tolerances of the boards to result in mis-alignment of the connectors. The designs shown herein are capable of mating despite misalignment of over 1 mm.

Furthermore, the design allows for shielding over substantially the full length of the signal contact portions. Shielding adjacent the signal contacts reduces crosstalk between signal conductors. It can also be important to controlling the impedance of the signal conductors.

Having described one embodiment, numerous alternative embodiments or variations might be made. For example, the orientation of the boards was described as horizontal and vertical. These dimensions are used in the illustration solely to give a frame of reference for the description of the preferred embodiment. In a commercial embodiment, the boards might be mounted with any different orientations driven by the requirements of the electronic assembly. Also, it should be appreciated that the type A and type B connectors need not be mounted on a board with any particular orientation. For example, the locations of the type A and type B connectors might be reversed.

It is also not necessary that the wafers be held in a housing, as shown. An organizer of any type might be used to position the wafers. For example, a metal strip having holes in which to receive features from each of the wafers could be used. Or, the wafers might be held in position by securing the wafers into a block with sufficient rigidity. The wafers, for example, might be held together with adhesive. Likewise, in an application in which the mechanical positioning of the contact tails is not critical, the housing might be eliminated.

As an example of another alternative, it should be appreciated that compliance in a plane was provided in the preferred embodiment by attachment features between cap 124 and housing 122 that allowed motion in two orthogonal directions in the X-Y plane. As an alternative, attachment features that allow compliance in only one direction might be provided with a type B connector. Compliance in the orthogonal direction might be provided by a similar structure on the type A connector—with the combination of the two thereby providing compliance in the plane.

The shield plates are shown in the mating area to be divided into fingers. In the illustrated embodiment, there are half as many fingers as there are signal conductors. In such an arrangement, signal conductors are grouped in pairs adjacent shield fingers. Such an embodiment is useful for making a differential connector in which one signal is carried on a pair of signal conductors. To further enhance the performance of the electrical connector, slits might be cut in the various shield plates. For example, slits might be cut in shields 236 to remove the conducting material between the signal conductors that form a pair carrying a differential signal. Conversely, slits might be cut in shield plates 336 to remove conducting material between the pairs of signal conductors, thereby increasing the electrical isolation between the signals carried by each pair.

Also, it should be appreciated that shields such as 236 are illustrated as having been stamped from a sheet of metal. A shield plate might alternatively be created by a conducting layer on the plastic.

Additionally, contacts 234 are shown with two beams pressing against opposing sides of shield 250. It would be possible to make an electrical contact with a single beam pressing against one side of the shield. Alternatively, it is not necessary that the beams be secured at both ends. A cantilevered beam might alternatively be used.

As another variation, it might be desirable to form cap 124 from a material with greater structural strength than plastic. Because the alignment of the connectors is achieved by forcing the connectors together until the walls of cap 124 guide cap 120 into position, there can be significant force placed on the walls of cap 124 during mating—depending on the number of conductors in a connector and the degree of misalignment between printed circuit boards. An alternative would be to cast cap 124 from anodized aluminum or otherwise form it from metal. If a conducting metal is used, it would then be necessary to insulate the signal conductors from the metal to avoid shorting the signal conductors. Plastic grommets or other insulator might be inserted in the holes in floor 252 to insulate the signal conductors from the metal. It might also be desirable to insulate the ground plates from the metal.

Also, it should be appreciated that alignment features such as 128 are illustrative of the shape and position of alignment features. More generally, any tapered surfaces that act to urge the connector pieces into proper alignment might be used. And, it is not necessary that the alignment features be formed into the connector pieces themselves. Separate alignment structures, such as alignment pins and holes might be attached to the connector housings or caps.

Further, it is not necessary that the wafers be manufactured by molding plastic over signal contacts. As an alternative way to embed the conductors in the insulator, an insulator might be molded over the shield piece, leaving space for the signal conductors in the insulator. The signal conductors might then be pressed into those spaces and affixed to the insulator. The signal conductors might be affixed to the insulator by using barbs on the signal conductors. Or features could be included in either the conductors or insulators to form an interference fit. Or, an over-molding of insulator might be applied to seal the space around the signal conductors, holding them in the insulator.

Also, it is not necessary that the shields be affixed to the signal subassemblies at all. It would be possible to construct a connector in which loose shield pieces are placed between signal subassemblies.

Another variation might be to place insulating members between adjacent signal conductors or between shield members and signal conductors. For example, shield 336, particularly fingers 354, might be coated with an insulator to prevent contact to signal conductors. Or, forward 422 insulator might be expanded to include openings to receive the contact portions. Thus, rather than insert the contacts into openings in cap 124, the openings would be already molded around the contacts and cap 124 would resemble more of a open frame.

Therefore, the invention should be limited only by the spirit and scope of the appended claims.

What is claimed is:

1. A matrix connector comprising:

a) a plurailty of subassemblies, each having a plurality of conductive elements disposed in a column such conductive element having a mating contact portion;

b) a plurality of first type shields each first type shield member disposed parallel to and adjacent a column of conductive elements in a subassembly;

c) a plurality of second type shields, each electrically connected to at least one first type shield, said second type shields having portions disposed between adjacent mating contact portions of signal conductors on the same subassembly, and d) wherein each of the first and second type shields have edge and the electrical connection between a first type shield and a second type shield is provided by a contact comprising:

i) a first opening along an edge of a selected one of said first or second type shields, the opening sized to receive an edge of the other of said first or second type shields; and ii) a second opening in the selected one of the shields, the second opening spaced from the first opening by a portion of the selected shield, thereby creating a beam that is pressed into the other of said shields when inserted into the first opening.

2. The connector of claim 1 additionally comprising an organizer comprising an insulative housing attached to the subassemblies.

3. The matrix connector of claim 2 wherein the insulative housing has a plurality of slots formed therein and each of the subassemblies has an insulative portion which include a tab engaged in one of the slots.

4. The matrix connector of claim 1 additionally comprising an organizer made of metal holding the subassemblies in parallel.

5. The matrix connector of claim 1 wherein each of the subassemblies has an insulative portion molded around the plurality of conductive elements.

6. The matrix connector of claim 1 wherein the conductive elements in each of the subassemblies has a mating contact portion that comprises a pin.

7. The matrix connector of claim 1 wherein each of the subassemblies has a first face and a second face with the mating contact portions of the conductive elements extending from the first face and with the first face and the second face are orthogonal to each other.

8. The matrix connector of claim 1 wherein the contact comprises a third opening in the selected one of the shields creating a second beam in the selected one of the shields passing into the other of said shield in opposition to the beam.

9. The matrix connector of claim 1 wherein first type shields each comprise a contact tail, adapted for making electrical connection to a printed circuit board, whereby the second type shields are electrically connected to the printed circuit board through shields of the first type.

10. The matrix connector of claim 1 wherein each of the second type shields is connected to each of the first type shields.

11. The matrix connector of claim 1 wherein each of the second type shields includes a plurality of contact regions, adapted to make electrical connection to a shield in a mating electrical connector.

12. The matrix connector of claim 1 additionally comprising a the cap made of an insulator, wherein the mating contact portions of the conductive elements is disposed within the cap.

13. The matrix connector of claim 12 wherein the cap comprises a plurality of side walls adapted for receiving a mating connector therebetween.

14. The matrix connector of claim 1 wherein each of conductive elements additionally comprises a contact tail and the connector additionally comprises a printed circuit board, with the contact tails electrically connected to the printed circuit board.

15. The matrix connector of claim 14 in a matrix assembly comprising a first plurality of boards mounted parallel to said printed circuit board and a second plurality of printed circuit boards mounted perpendicular to said board.

16. A matrix connector assembly comprising:

a) a first connector, comprising:

i) a plurality of first type subassemblies, each having an insulative portion and each with a plurality of conductive elements embedded therein, each conductive element having a mating contact portion extending from a first face of the insulative portion and a contact tail extending from a second face of the insulative portion, each of the first type subassemblies disposed in parallel with the mating contact portions disposed in a rectangular array in a mating area;

ii) a plurality of first type shields each first type shield disposed parallel to and adjacent at least one of the first type subassembly;

iii) a plurality of second type shields, each electrically connected to at least one first type shield, said second type shields having mating portions disposed in the mating area between adjacent mating contact portions of signal conductors on the same subassembly; and b) a second connector, comprising:

i) a plurality of second type subassemblies, each having an insulative portion and each with a plurality of conductive elements embedded therein, each conductive element having a mating contact portion extending from a first face of the insulative portion and a contact tail extending from the insulative portion, each of the first type subassemblies disposed in parallel with the mating contact portions disposed in a second rectangular array in a second mating area;

ii) a plurality of third type shield members, each third type shield member disposed parallel to and adjacent a second type subassembly, each third type shield having a mating portion extending into the second mating area;

c) wherein, when the first connector and second connector are mated, the mating contact portions of the first connector make contact with the mating contact portions of the second connector and the mating portion of the second shield contacts the mating portion of the third shield.

17. The matrix connector assembly of claim 16 wherein the first connector includes a front housing having side walls bounding the mating area.

18. The matrix connector assembly of claim 17 wherein the front housing comprises an insulator and the plurality of second type shields are attached to the front housing in parallel with a side wall.

19. The matrix connector of claim 17 wherein each of the second type shields is connected to each of the first type shields.

20. The matrix connector of claim 17 Wherein each of the first type shields includes at least one slot therein with a compliant portion therein, with a second type shield inserted in the slot and making connection to the compliant portion.

21. A matrix connector assembly comprising:

a) a first connector comprising:

i) a plurality of first type subassemblies, each of the first type subassemblies having a plurality of signal conductors aligned in a column;

ii) a plurality of first type shields, each of the first type shields disposed in parallel with a column of signal conductors of one of the plurality of first type subassemblies, each of the first type shields disposed between columns of signal conductors in adjacent first type subassemblies;

iii) a plurality of second type shields connected to the first type shields; and b) a second connector comprising:

i) a plurality of second type subassemblies, each of the second type subassemblies having a plurality of signal conductors aligned in a column;

ii) a plurality of third type shield., each of the third type, shields disposed in parallel with a column of signal conductors of one of the plurality of second type subassemblies, each of the third type shields disposed between columns of signal conductors in adjacent second type subassemblies;

iii) wherein the third type shields are electrically connected to the second type shields in the first connector.

22. The matrix connector assembly of claim 21 wherein the second type shields and the third type shields have planar portions that are aligned in parallel and a single second type shield electrically connects to a single third type shield at a plurality of points over the planar portions.

23. The matrix connector assembly of claim 22 wherein each of the first type subassemblies includes an insulative portion and the plurality of signal conductors is embedded in the insulative portion.

24. The matrix connector assembly of claim 23 wherein each of the first type shields is disposed between the insulative portion of adjacent first type subassemblies.

* * * * *